US005236043A

United States Patent [19]

Armbruster et al.

[11] Patent Number: 5,236,043

[45] Date of Patent: Aug. 17, 1993

[54] OIL COOLER

[75] Inventors: Horst Armbruster, Illingen; Gebhard Schwarz, Stuttgart, both of Fed. Rep. of Germany

[73] Assignee: Behr GmbH & Co., Fed. Rep. of Germany

[21] Appl. No.: 933,691

[22] Filed: Aug. 24, 1992

[30] Foreign Application Priority Data

Aug. 24, 1991 [DE] Fed. Rep. of Germany ..... 4128153

[51] Int. Cl.[5] ..... F28F 3/08

[52] U.S. Cl. ..... 165/167; 165/916; 137/855

[58] Field of Search ..... 165/167, 916; 137/855

[56] References Cited

U.S. PATENT DOCUMENTS

| | | | |
|---|---|---|---|
| 1,652,793 | 12/1927 | Perry | 137/855 |
| 3,743,011 | 7/1973 | Frost | 165/38 |
| 4,360,055 | 11/1982 | Frost | 165/38 |
| 4,561,494 | 12/1985 | Frost | 165/76 |
| 4,669,532 | 6/1987 | Tejima et al. | 165/36 |
| 4,742,866 | 5/1988 | Yamanaka et al. | 165/167 |
| 4,967,835 | 11/1990 | Lefeber | 165/167 |
| 5,014,775 | 5/1991 | Watanabe | 165/167 |
| 5,078,209 | 1/1992 | Kerkman et al. | 165/167 |

FOREIGN PATENT DOCUMENTS

| | | | |
|---|---|---|---|
| 0434553 | 6/1991 | European Pat. Off. . | |
| 2729202 | 3/1978 | Fed. Rep. of Germany . | |
| 2843423 | 12/1979 | Fed. Rep. of Germany . | |
| 3341263 | 5/1985 | Fed. Rep. of Germany . | |
| 3440064 | 5/1986 | Fed. Rep. of Germany . | |
| 3824074 | 1/1990 | Fed. Rep. of Germany | 165/916 |
| 60-233310 | 11/1985 | Japan . | |
| 61-44294 | 3/1986 | Japan . | |
| 62-614 | 1/1987 | Japan . | |
| 62-17594 | 1/1987 | Japan . | |
| 62-73089 | 4/1987 | Japan . | |
| 1041719 | 9/1983 | U.S.S.R. . | |
| 1590573 | 9/1990 | U.S.S.R. . | |

*Primary Examiner*—John Rivell
*Assistant Examiner*—L. R. Leo
*Attorney, Agent, or Firm*—Evenson, McKeown, Edwards & Lenahan

[57] ABSTRACT

Known disk oil coolers, when they are to be used without an oil filter, are provided with a separate housing cover which, by means of a sealing device, is disposed on a ring surface of the housing and is held on the housing by way of a hollow screw. These constructions require a large amount of space. It is disclosed to provide the hollow screw, on the side of the driving surfaces for a screwing tool directed toward the housing, with an end disk which is provided with a sealing surface resting against an annular wall of the housing. On the side of the end disk facing the housing, an opening is provided which leads into the interior of the hollow screw. This hollow screw may be used instead of the hollow screw to be provided for the use with the filter. Elaborate modifications or other housings are not required.

9 Claims, 4 Drawing Sheets

FIG. 1
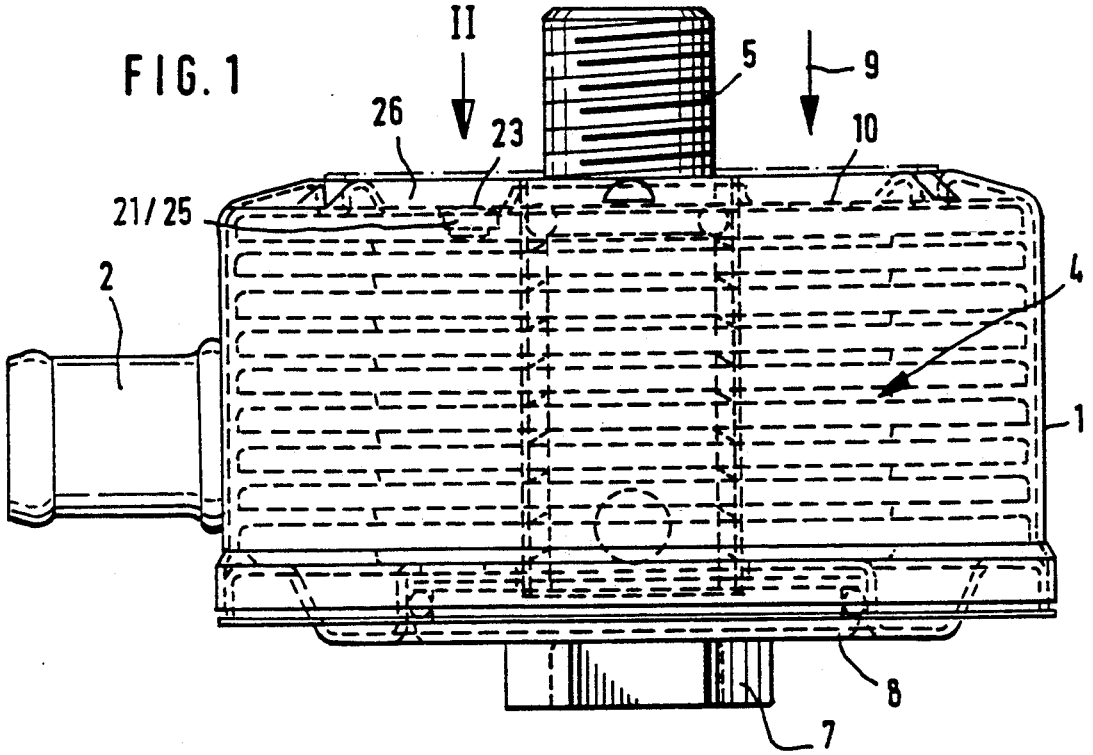
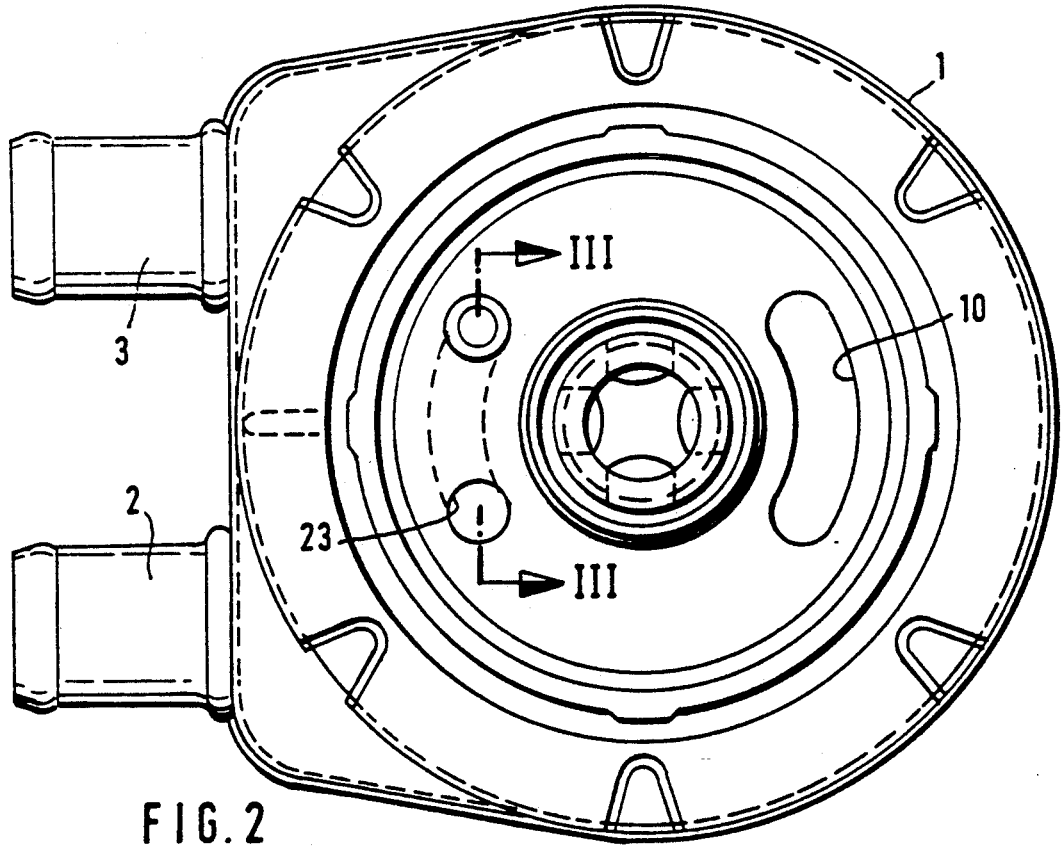
FIG. 2

FIG. 7
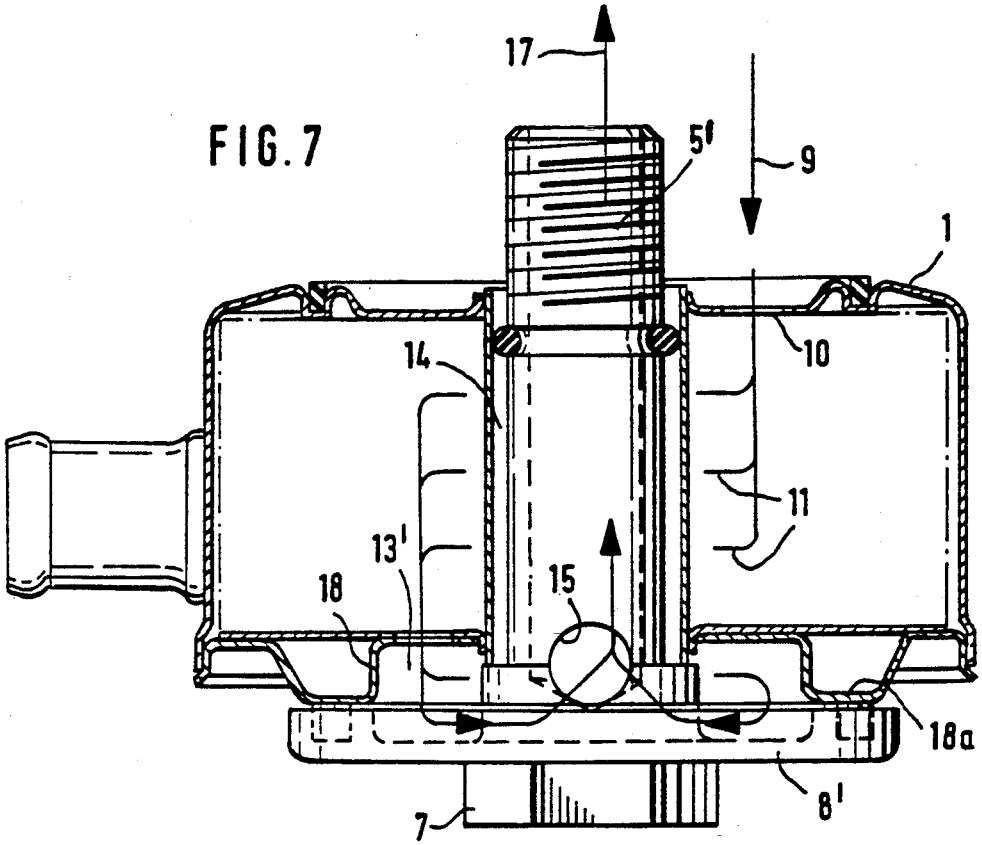
FIG. 8
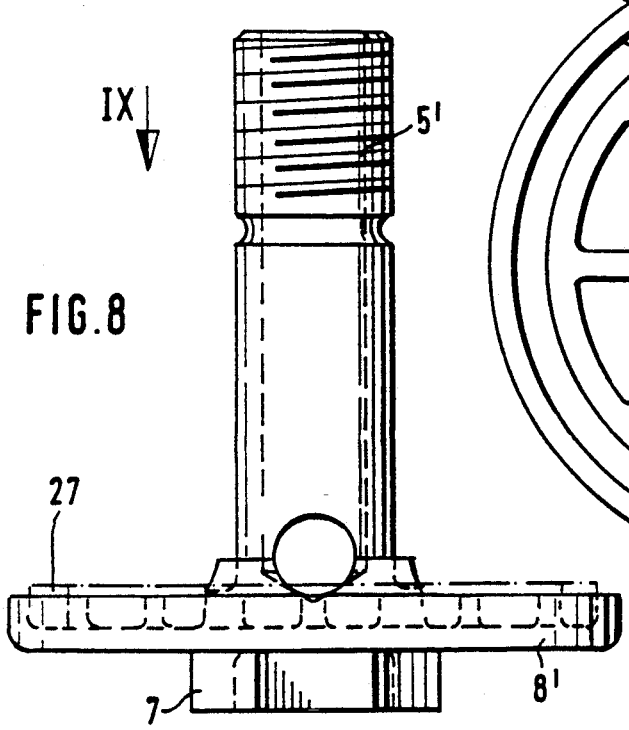
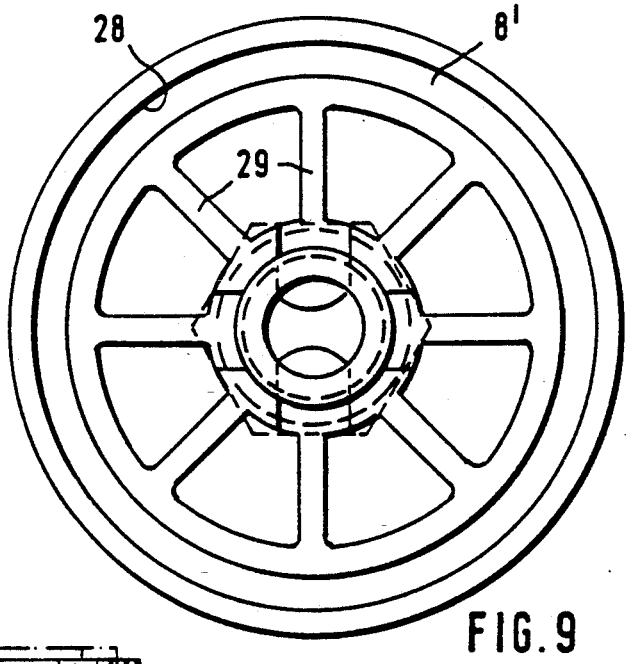
FIG. 9

OIL COOLER

BACKGROUND AND SUMMARY OF THE INVENTION

This invention relates to an oil cooler comprising a housing with connections for the supply and removal of a coolant, and comprising several hollow disks or plates through which the oil flows that is to be cooled. The disks are aligned and are connected with one another by means of their interiors and are fitted onto a hollow screw provided in the housing. The hollow screw is used for the fastening of the housing on the engine block and for the connection to a recirculating bore for the oil which flows off through the hollow screw through the interiors of the hollow disks and by way of a chamber, which is situated on the side of the housing facing away from the engine block and bounded by a circular wall.

Oil coolers of this type are known (U.S. Pat. Nos. 4,360,055 and 4,561,494). These oil coolers are used in connection with an oil filter which is placed on the side of the oil cooler facing away from the engine block and is held by the hollow screw. If such oil coolers are to be used without a filter, it is necessary, as a rule, to change the housing and the bundle of hollow plates or disks in such a manner that oil will no longer flow out on the side facing away from the engine block. It is therefore necessary to provide different oil coolers, depending on whether they are to be used together with an oil filter or without one. This requires high expenditures.

It is true that it is known from U.S. Pat. No. 4,669,532 to close off an oil cooler of the initially mentioned type having an open housing on the side facing away from the engine block by means of a separate housing cover which, by means of a sealing device, is placed on the outside on a ring area of the housing and is held on the housing by means of a hollow screw which projects into a dome of the cover by means of a threaded pipe and, in the space between the dome and a hexagon, has bores for the connection of the chamber formed inside the cover with the interior of the hollow screw. However, constructions of this type, because of the additional cover, take up a relatively large amount of space which is sometimes not available in motor vehicles. In addition, the mounting of the closing cover results in relatively high expenditures.

It is therefore an object of the invention to develop an oil cooler of the initially mentioned type in such a manner that it is suitable for use with a filter as well as for use without a filter and can be made available for the respective desired use without any expenditures.

In order to achieve this object, it is provided in the case of an oil cooler of the initially mentioned type that the hollow screw, on the side of the driving surfaces for a screwing tool which is directed toward the housing, is provided with a closing disk which is mounted on it in a collar-type manner and which is provided with a sealing surface resting against the annular wall, and because of the fact that, on the side of the end disk facing the housing, an opening is provided which leads into the interior of the hollow screw. Because of this development, the hollow screw, which is to be provided for use with the filter and is open on both ends, must only be replaced by the hollow screw with the end disk in which case the driving surfaces for a screwing tool, which are provided on the hollow screw which is closed on one side, may be used in a simple manner also for the sealing-off of the end disk. In this case, it is possible to place the sealing surface in each case on the circumference of the end disk and let it interact with the surface of the annular wall directed toward the interior, or to arrange the sealing surface on the side of the end wall which points in the direction of the housing and to let it interact with the face of the annular wall pointing toward the exterior. Particularly in the former case, where the end wall of the hollow screw is situated almost completely sunk inside the space of the annular wall, an extremely space-saving construction is achieved. The handling of the hollow screw is simple in either case.

It is particularly advantageous according to certain preferred embodiments to provide, on the side of the housing facing away from the chamber, in addition to the feeding opening of the first hollow disk connected to the inflow coming from the engine block, an additional opening in the housing and in the side of the first hollow disk bordering on the housing which can be kept closed by means of a pressure control valve which is disposed on the interior side of the hollow disk and opens toward the inside. By means of this development, it also becomes possible in the case of the compact space-saving construction according to the initially mentioned invention to let engine oil very rapidly flow through the oil cooler when the oil is still cold and correspondingly viscous. The reason is that the valve arrangement situated on the engine side, in such a case, opens the direct flow-through path through the hollow disks so that an excessive pressure loss can be avoided.

It is true that it is basically known in the case of disk oil coolers to provide such valves which open at higher pressures. U.S. Pat. No. 4,669,532, for example, shows such a helically constructed valve. U.S. Pat. No. 3,743,011 is also provided with such a valve within the range of the hollow screw, and U.S. Pat. No. 4,360,055 shows a bow-shaped valve in the space between the filter and the oil cooler housing. In the case of the present further development of the invention, however, the valve is arranged on the other side of the oil cooler housing, specifically on the side facing the engine block, specifically while opening toward the interior. This development makes it possible to provide a disk oil cooler with such a valve without any additional space requirement for the arrangement of the valve on the side of the housing facing away from the engine block. It is also advantageous for the hollow screw and the end disk to be constructed in two parts because, as a result, the manufacturing costs may be kept low.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic cross-sectional view of a disk oil cooler constructed according to a preferred embodiment of the present invention;

FIG. 2 is a top view of the disk oil cooler of FIG. 1, viewed in the direction of the arrow II;

FIG. 7 is a representation of the housing and of the bundle of disks of the disk oil cooler of FIG. 1 and 2, but with another closing hollow screw which seals off axially;

FIG. 8 is a view of the closing hollow screw which was used for the disk oil cooler of FIG. 7;

FIG. 9 is a view of the closing hollow screw of FIG. 8 viewed in the direction of the arrow IX of FIG. 8.

DETAILED DESCRIPTION OF THE DRAWINGS

Figure 4:
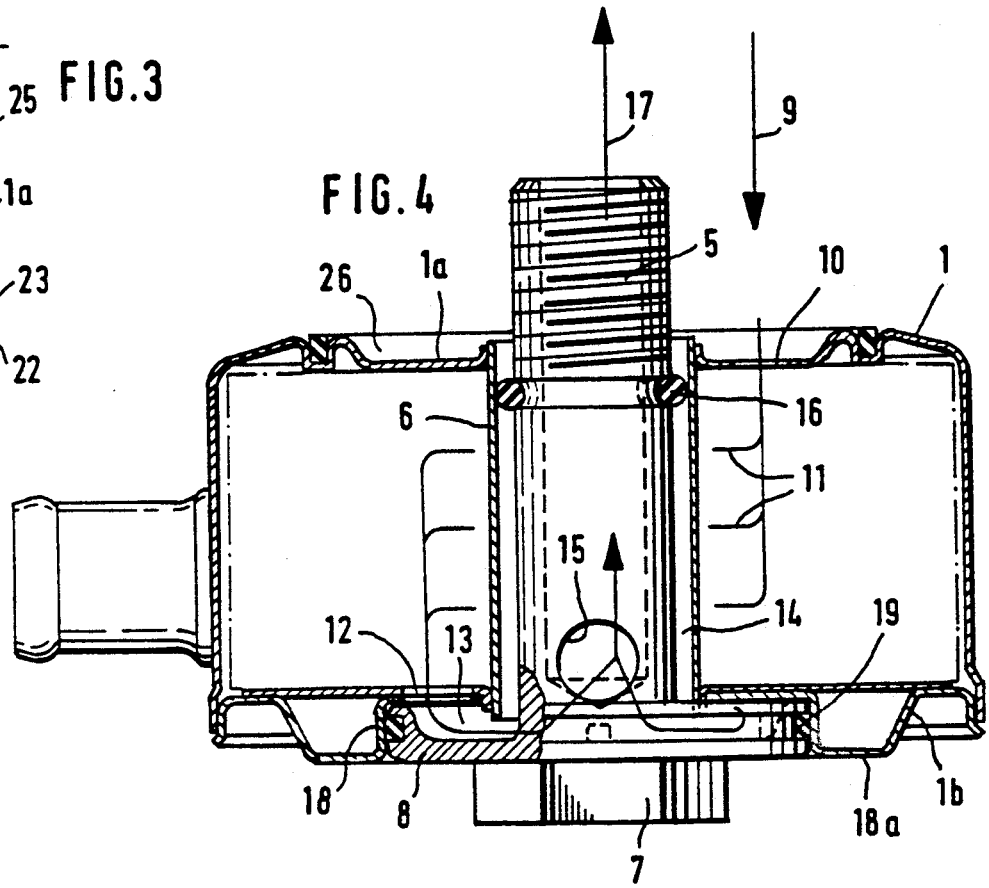
FIG. 4 is a schematic representation of the oil cooler of FIG. 1 with a representation of the course of the flow of the oil to be cooled.

FIGS. 1, 2 and 4 illustrate a disk oil cooler which comprises a can-shaped housing 1 having two lateral connections 2, 3 for the inflow and discharge of a coolant and a bundle 4 of disks inserted into this housing 1. The housing 1, which for the purpose of improving clarity is drawn in FIG. 4 without the bundle of disks, is penetrated by a hollow screw which is guided through a sleeve 6 disposed in the center in the housing 1. The hollow screw 5 is provided with a hexagon 7 and with an end disk 8, and, on the side facing away from the hexagon 7, is connected with an engine block by means of a thread, in a manner which is not shown in detail. In this case, the oil from the engine block that is to be cooled comes from a duct, which is also not shown, flowing in the direction of the arrow 9, passes through an approximately kidney-shaped opening 10 and a correspondingly shaped opening, which is not shown in detail, and flows into the hollow space of the first disk and is then distributed in the direction of the flow arrows indicated in FIG. 4 inside the individual disks of the bundle 4 of disks and leaves the housing 1 by way of an opening 12 in the lower front wall 1*b* of the housing 1. The oil, which flowed through the individual disks in this manner, will then be deflected into a chamber 13 which is formed by a recess on the interior side of the end disk 8 and can then enter, through the space 14 between the sleeve 6 and the hollow screw 5, into four bores 15 that are uniformly distributed along the circumference of the hollow screw 5. The oil is then recirculated in a cooled state to the engine in the direction of the arrow 17 via the interior of the hollow screw 5, which is sealed off by a sealing ring 16 with respect to the sleeve 6. The end disk 8 in this case is situated in a circular recess 18 formed by an annular wall 18 of the lower end wall 1*b* and is sealed off by a surrounding sealing ring 19 with respect to the interior side of the annular wall 18, the sealing ring being held in a surrounding groove 20 on the circumference of the end disk 8. As illustrated in detail in FIGS. 5 and 6, the hollow screw 15, which may also be in one piece, is composed of two parts for manufacturing reasons the end disk 8 forming one of these parts. The end disk 8 is undetachably connected with the hollow screw 5. However, it may also be slid by means of a central bore onto the hollow screw which in this case is provided with the hexagon 7. A sealing device would also have to be provided between the hollow screw 5 and the end disk.

As indicated in FIGS. 1, 2 and particularly in FIG. 4, after the removal of the hollow screw 5 which, by the way, by means of the face of its end disk situated on the outside is in alignment with the face 18*a* of the annular wall 18 directed toward the outside, it is also possible to use the same housing with the bundle of disks for an oil cooler to which, in addition, an oil filter is assigned on the side of the annular wall 18. This oil filter would then rest sealingly on the surface 18*a*, and the oil flowing through the bundle of disks in the direction of the arrows 11 would then first flow into the filter and only from there would flow back through the hollow screw, which projects into the filter, in the direction of the arrow 17. One and the same oil cooler housing, including the bundle of disks, may therefore be used with or without an oil filter.

In this case, the hollow screw 5 illustrated in FIGS. 1 to 6 has the advantage that the space requirement of the oil cooler, when it is used without any filter, is very low. The reason is that the end disk requires no additional space and only the hexagon 7, which is necessary for the operating of the hollow screw 5, projects beyond the contour of the housing 1 toward the outside.

Figure 3:
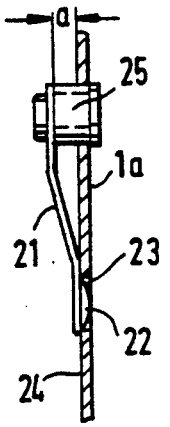
FIG. 3 is a partial sectional view of the outer housing wall and the first hollow disk of the disk oil cooler of FIG. 1 and 2 along the section line III—III.

However, as also shown in FIGS. 2 and 3, the oil cooler of FIGS. 1 to 6 is provided in addition with a valve which permits a direct flow through the bundle of disks without the deflecting of the oil through the individual disks in the case in which, for example, during the start of the engine, the oil is still relatively cold and viscous and would be subjected to an excessive pressure loss if it had to be deflected through the hollow disks of the bundle 4 of disks. In this case, this valve consists of a leaf spring strip 21 which is provided on one end with a valve piece in the shape of a spherical segment 22 and by means of which closes a circular opening 23 in the front wall 1*a* of the housing 1 and in the wall of the first hollow disk of the bundle 4 of disks which borders on this front wall 1*a*, the wall of the first hollow disk having the reference number 24. By means of its other end, the leaf spring strip 21 is held on a base part 25 which is inserted firmly into the wall 24 and 1*a*. In this case, the base piece projects by means of the end carrying the leaf spring strip 21 into the interior of the first hollow disk which is not shown in detail. In this case, the end of the leaf spring strip 21 is fastened to the base 25 in such a manner that the distance (a) will remain between the fastening point and the wall 24. In a particularly good manner, this development permits that the spherical segment piece 22 is held in the opening 23 in a tight and easily detachable manner.

As demonstrated very clearly when looking at FIGS. 1, 2 and 4, the oil coming from the engine block in the direction of the arrow 9 will first be present in the chamber 26, specifically, when it is cold and still very viscous, under a high pressure. As a result of this pressure, the spherical-segment-shaped closing piece 22 is pressed open in the direction of the arrow 9 toward the inside and the oil can then flow through the axially aligned connection openings, which are not shown in detail, between the individual hollow disks directly to the outlet opening 12 and from there back to the engine without being subjected to an excessive and undesirable loss of pressure. In this case, the space-saving construction of FIGS. 1 to 6 does not have to be changed which is very advantageous, particularly when only limited installation space is available in the engine. Despite the compact and space-saving design, the new oil cooler—like other constructions requiring significantly higher expenditures—offers the possibility of guiding oil, at the time of the start of the engine, directly through the oil cooler without any significant loss of pressure.

FIGS. 7 to 9 show the same design of the housing 1 as explained by means of FIGS. 1 to 6. Also in this case, a valve according to FIG. 3 may be provided. The only difference is the hollow screw 5' used in the embodiment of FIGS. 7 to 9 which, instead of the end disk 8 resting against the interior wall of the annular wall 18, is provided with an end wall 8' which is constructed as a plate whose dimensions correspond to the diameter of the ring wall 18 and its face 18*a*. This plate-shaped end disk 8' is axially supported on the surface 18*a* and is sealed off with respect to it by means of a surrounding sealing ring 27 which is inserted into a ring groove 28 extending around the interior side of the end wall 8'. As indicated in FIGS. 8 and 9, the plate-shaped end disk 8' is reinforced by radially extending ribs 29. However, the remaining design corresponds again to that of FIGS. 1 to 6. In this case, the deflecting chamber 13', which is formed between the end disk 8' and the housing 1, is slightly larger. Because of the disk 8', which rests on the outside on surface 18*a*, the space requirement is also slightly higher than in the embodiment of FIGS. 1, 2 and 4. Also in the case of this variant, the end disk may be fitted onto the hollow screw by means of a bore so that it is situated on the side of the hexagon 7 directed toward the housing.

Figure 5:
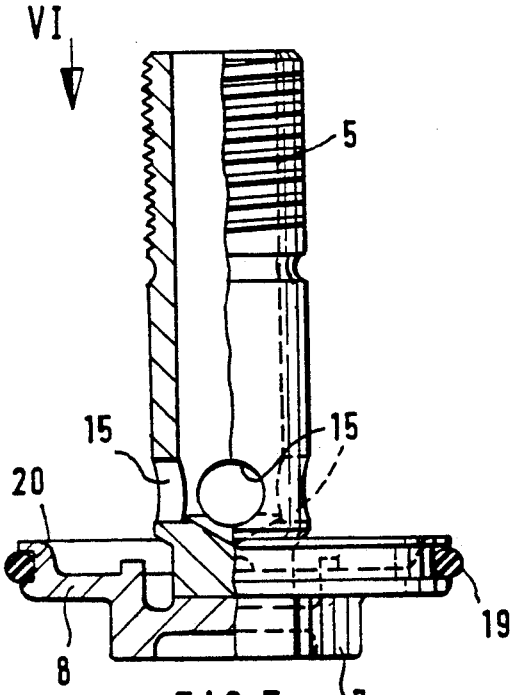
FIG. 5 is a view of the closing hollow screw used for the embodiment of FIG. 1, 2 and 4.
Figure 6:
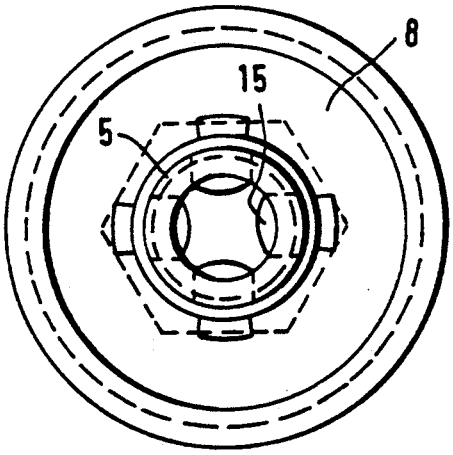
FIG. 6 is a view of the hollow screw in the direction of the arrow VI of FIG. 5.
Figure 10:
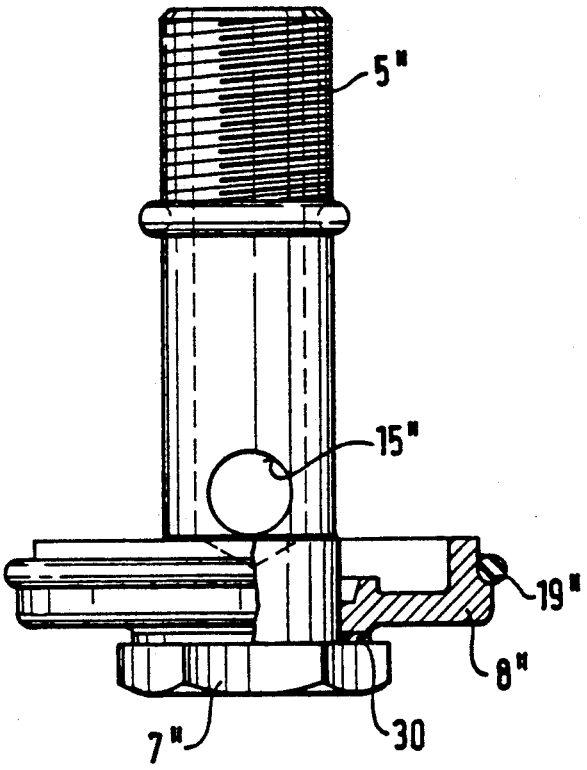
FIG. 10 is a view of another embodiment of the closing hollow screw.

FIG. 10 illustrates an embodiment of a hollow screw 5" which in principle corresponds to that of FIG. 5. In this case also, the hollow screw 5" is provided with a hexagon 7" and, on the side facing away from this hexagon 7", is provided with a thread. The hollow screw 5" also has the openings 15" which open its interior toward the outside, and a sealing ring 19" is provided on the circumference of the end disk 8". The difference with respect to the embodiment of FIG. 5 is that the end disk 8" is manufactured separately from the hollow screw 5" and is arranged on its shaft by means of a close sliding fit. For the sealing-off with respect to the hexagon, a sealing ring 30 is provided. The manufacturing of the hollow screw 5" with the end disk 8" is easier because of the two-piece construction. The operation is the same as in the case of the construction of FIGS. 1 to 5.

Although the invention has been described and illustrated in detail, it is to be clearly understood that the same is by way of illustration and example, and is not to be taken by wa of limitation. The spirit and scope of the present invention are to be limited only by the terms of the appended claims.

What is claimed:

1. A disk oil cooler comprising:

a housing with connections for the supply and removal of a coolant, a plurality of hollow disks through which the oil flows that is to be cooled, said disks being aligned and connected with one another by means of their interiors, and a hollow screw provided in the housing, the hollow screw being used for the fastening of the housing on an engine block and for the connection to a recirculating bore for the oil which flows off through the hollow screw through the interiors of the hollow disks and by way of a chamber which is situated on a side of the housing facing away from the engine block, wherein the hollow screw is provided with an end disk which is mounted on it in a collar-type manner on an end of the hollow screw provided with driving surfaces for a screwing tool, the end disk being provided with a sealing surface resting against an annular wall of the housing, and wherein an opening is provided which leads to the interior of the hollow screw on the side of the end disk facing the housing, wherein, on the side of the housing facing away from the chamber, in addition to the feeding opening to the first hollow disk connected to the flow coming from the engine block, an additional opening is provided in the housing and in the wall of the first hollow disk bordering on the housing, this additional opening being held closed by means of a pressure control valve which is disposed on the interior side of the hollow disk and opens up toward the inside.

2. A disk oil cooler according to claim 1, wherein the sealing surface is situated on a circumference of the end disk and interacts with the surface of the annular wall directed toward the inside.

3. A disk oil cooler according to claim 2, wherein the end disk is detachably mounted on the hollow screw, particularly by means of a close sliding fit on the shaft of the hollow screw.

4. A disk oil cooler according to claim 1, wherein the end disk is detachably mounted on the hollow screw, particularly by means of a close sliding fit on the shaft of the hollow screw.

5. A disk oil cooler according to claim 1, wherein the pressure control valve consists of a closing piece held by a leaf spring strip.

6. A disk oil cooler according to claim 5, wherein the closing piece is a spherical-segment-shaped part which is adapted to a circularly designed opening.

7. A disk oil cooler according to claim 6, wherein the closing piece is held by way of a leaf spring strip on a base piece which is fixedly inserted into the wall of the hollow disk and of the housing.

8. A disk oil cooler according to claim 7, wherein the end of the leaf spring strip fastened to the base piece is situated at a distance to the wall of the hollow disk.

9. A disk oil cooler comprising:

a housing with connections for the supply and removal of a coolant, a plurality of hollow disks through which the oil flows that is to be cooled, said disks being aligned and connected with one another by means of their interiors, and a hollow screw provided in the housing, the hollow screw being used for the fastening of the housing on an engine block and for the connection to a recirculating bore for the oil which flows off through the hollow screw through the interiors of the hollow disks and by way of a chamber which is situated on a side of the housing facing away from the engine block, wherein the hollow screw is provided with an end disk which is mounted on it in a collar-type manner on an end of the hollow screw provided with driving surfaces for a screwing tool, the end disk being provided with a sealing surface resting against an annular wall of the housing, and wherein an opening is provided which leads to the interior of the hollow screw on the side of the end disk facing the housing, wherein the sealing surface is part of a surrounding sealing ring which is held in a groove of the end disk wall and is situated on the side of the end wall facing toward the housing and interacts with the face of the annular wall which faces toward the outside, wherein the end disk is detachably mounted on the hollow screw, particularly by means of a close sliding fit on the shaft of the hollow screw, wherein, on the side of the housing facing away from the chamber, in addition to the feeding opening to the first hollow disk connected to the flow coming from the engine block, an additional opening is provided in the housing and in the wall of the first hollow disk bordering on the housing, this additional opening being held closed by means of a pressure control valve which is disposed on the interior side of the hollow disk and opens up toward the inside.

* * * * *